US006665939B1

(12) United States Patent
Adachi

(10) Patent No.: US 6,665,939 B1
(45) Date of Patent: Dec. 23, 2003

(54) SCISSORS WITH HOLE PARTS

(76) Inventor: Hidemi Adachi, c/o Adachi Kogyo, Inc., 489-1, Hiromi, Seki-shi Gifu-ken (JP), 501-3263

( * ) Notice: Subject to any disclaimer, the term of this patent is extended or adjusted under 35 U.S.C. 154(b) by 111 days.

(21) Appl. No.: 09/889,329

(22) PCT Filed: Oct. 6, 2000

(86) PCT No.: PCT/JP00/07014

§ 371 (c)(1),
(2), (4) Date: Jul. 16, 2001

(87) PCT Pub. No.: WO02/30632

PCT Pub. Date: Apr. 18, 2002

(51) Int. Cl.[7] ..... B26B 13/20
(52) U.S. Cl. ..... 30/232; 30/341
(58) Field of Search ..... 30/231, 232, 340, 30/341, 254

(56) References Cited

U.S. PATENT DOCUMENTS 4,364,174 A * 12/1982 De Asis ..... 30/153
6,272,754 B1 * 8/2001 Hesprich ..... 30/232

FOREIGN PATENT DOCUMENTS

JP 8-336677 * 12/1996
WO WO 01/072480 A1 * 10/2001

* cited by examiner

*Primary Examiner*—Hwei-Siu Payer
(74) *Attorney, Agent, or Firm*—Perkins, Smith&Cohen; Jerry Cohen

(57) ABSTRACT

Scissors having two shear bodies joined to each other for opening and closing movements, each shear body composed of a blade with a pivot portion, a shank, and a finger grip, wherein the shank of each blade has a desired portion distal from the pivot portion thereof arranged wider in a plan view and a first opening provided in the wider portion thereof, allowing the shank of each shear body to be reduced in weight and also improved in strength against deflection. The finger grip having a circumferential portion thereof arranged wider in a plan view than the shank's proximal portion and a second opening provided in the wider circumferential portion thereof to allow accessories such as a finger brace and a hit point to be mounted to the circumferential portion of the finger grip at the outside of the second opening.

6 Claims, 13 Drawing Sheets

SCISSORS WITH HOLE PARTS

FIELD OF THE INVENTION

The present invention relates to improvement of scissors, in particular haircutting scissors, having finger grips reduced in weight to contribute to the light weight of the scissors. At the same time, the finger grips and handle allow increased strength against deflection, even when screws are used for joining members. The finger holes do not interrupt the smooth comfortable finger grips even when combined with a finger brace and hit point for the finger grips.

BACKGROUND OF THE INVENTION

It is an object of the present invention, by eliminating the below-described drawbacks, to provide scissors which are light weight and have shanks of improved the strength against deflection to the opening and closing movements and particularly to scissors which when accessory members, such as a finger brace and a hit point, are mounted to the finger grips, their mounting thread holes can provide no irritation to the fingers.

While stainless steel has commonly been used for making haircutting scissors, it is increasingly replaced by lighter materials including titanium alloys and ceramics.

Haircutting scissors may also have a body and grips made of plastic material with the blades shaped of stainless steel.

However it is difficult to machine titanium alloys and ceramic materials which are highly brittle. As scissors with their finger grips made of a plastic material look cheap, they are not popular. As a result, complete stainless steel scissors are the most commonly available.

Alternatively, the weight of scissors may be reduced by thinning the blades. Illustrated in FIG. 13 are scissors 100 of which the shear body 110 comprises a blade 101, a shank 102, and a finger grip 103 all thinned. Since the blades 101,101 are subject to tension when closed, they cannot be thinned excessively. When the shank 102 is excessively thinned, it may deflect when cutting hair. Such deflection scissors reduces working efficiency due to the irritation and uncomfortable grip.

The finger grip 103 of a thin ring shape may discomfort or injure the finger of the user. It is preferably of a tubular shape but not a ring shape for ease of handling. However, the tubular shape is heavier than the ring shape and does not reduce the overall weight of the scissors.

Also, since the user places their finger in the finger grip 103 the improvement of comfort is a critical issue.

The finger grip 103 may have a finger brace 130 provided thereon for ease of the operation. In fact, the finger brace 130 is either made integral with or prepared separately and joined to the finger grip 103 as shown in FIG. 13.

As shown in FIG. 14, the finger brace 130 separately prepared has a thread provided in a proximal end 131 thereof and is threaded into a thread hole 103*a* provided in the finger grip 103. The thread hole 103*a* is a through hole providing an inner space in the finger grip 103. The finger when inserted in the finger grip 103 may remain in direct contact with and thus be irritated by the through hole. Since scissors are alternately opened and closed in minimum strokes for cutting the hair, the irritation would be on-going.

When the through hole 103*a* is replaced with a bottomed hole, its other end will not appear on the inner wall of the finger grip 103 thus eliminating the annoyance. However, the bottomed hole may shorten the thread. As a result, the threading will be declined in the joining strength. Also, while the thread is being machined, resultant cutting scraps will hardly be removed out from the bottomed hole.

Also, the finger grip 103 may commonly be accompanied with a hit point 120. The hit point 120 is normally made of a cushioning material such as rubber or synthetic resin and located at the place where the paired grips 103,103 strike against each other when the scissors are closed. For eliminating striking noises, the hit point 130 is mounted to one of the grip pair 103. As a result, the hit point 130 can eliminate the striking noises and minimize the impact of striking. The hit point 120 of e.g. a rubber material may have a tiny screw mounted to the bottom thereof for threading into a corresponding thread hole provided in the finger grip. This corresponding thread hole is also a through hole for the same reason. The hit point 120 may be made of a screw shape of a rubber material which is fitted into a corresponding hole provided in the finger grip. In this case, the other end of the hit point 120 may appear on the other side. In either case, the finger when inserted into the finger grip 103 may be directly engaged with and annoyed by the other end of the hit point 120. As the finger comes in direct contact with the hole, it may physically be interrupted by the distal end of the hit point 120.

SUMMARY OF THE INVENTION

As described below, the present invention is directed towards scissors having two shear bodies joined to each other for opening and closing movements, each the shear body composed of a blade, a shank, and a finger grip.

In the present invention, the shank has a first opening provided therein for reducing the weight. In particular, the shank also has a desired portion thereof arranged wider in a plan view and the first opening is provided in the desired wider portion of the shank for ease of determining its shape. This permits the opening to come through in a direction of the plan view. The shank is arranged wider in the plan view thus to provide a generous size of the first opening.

In the present invention, the first opening may be arranged extending lengthwise of the shank so that the shank has two rib portions. As the opening come through in the direction of the plan view, the two rib portions on both sides of the opening can ensure a favorable level of the strength against deflection when the scissors are closed. For example, even if the total cross section of the two rib portions is smaller than the cross section of a conventional shaft, they can be equal or higher in the strength against deflection than the conventional shaft.

In the present invention, accessories such as a finger brace and a hit point may be provided. More specifically, while the finger grip has a circumferential portion thereof arranged wider in a plan view, a second opening is provided in its wider circumferential portion. This allows the accessories to be mounted to the circumferential portion of the finger grip at the outside of the second opening. When a through hole (of threaded or insertion type) is provided in the finger grip for mounting the accessory, its location is in the circumferential portion of the finger grip at the outside of the second opening. As a result, the through hole can hardly interrupt the finger which stays directly on the inner portion of the finger grip.

In the present invention, the first opening and the second opening may be provided in a combination.

In the present invention, the first opening when provided may be shut up with a light member of which the material is smaller in the weight than that of the shank while the second opening may also be shut up with a light member of which the material is smaller in the weight than that of the shank. When both the first and second openings are provided, some or all of them may be shut up with a light member of which the material is smaller in the weight than the shank.

Accordingly, the first and second openings can be prevented from receiving any piece of hair. Also, the light members may be made of a colored material which is different from the color of the scissors, thus improving the appearance of the scissors.

BEST MODE FOR CARRYING OUT THE INVENTION

Some embodiments of the present invention will be described in more detail.

Figure 1A:
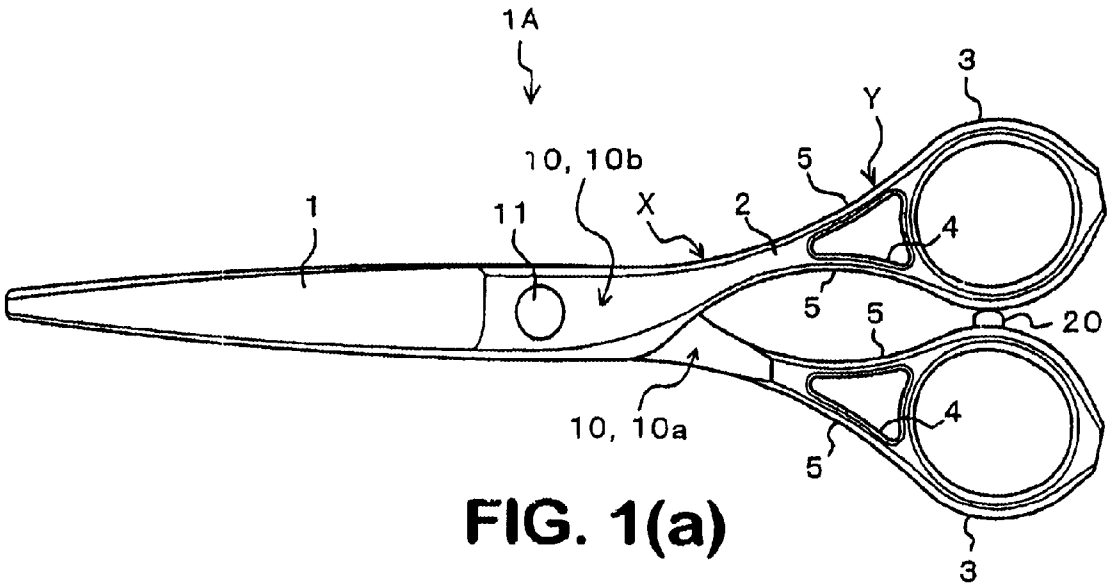
FIGS. 1*a* and 1*b* are a plan view and a side view of scissors having first openings provided in shanks thereof.
Figure 1B:
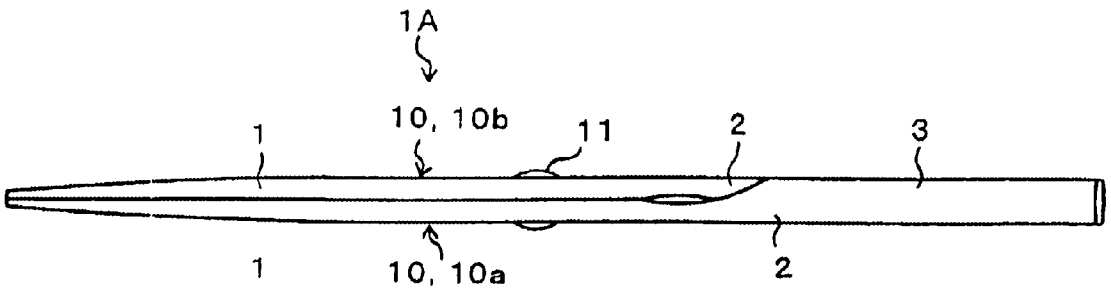

FIG. 1 illustrates a haircutting scissors 1A comprising a shear bodies 10 made of stainless steel and joined to each other for pivotal movement about a pivot 11 for opening and closing. Each of the shear bodies 10,10 comprises a blade 1, a shank 2, and a finger grip 3.

The shank 2 has commonly a bar-like shape at the proximal side X (adjacent to the pivot 11) and a plate-like shape at the distal side Y (adjacent to the finger grip 3), as shown in FIG. 1. More specifically, the overall shape of the shank 2 is similar to a narrow triangle having the proximal side X as a vertex and the distal side Y as a bottom. The shank 2 has substantially a first opening 4 of a narrow triangular shape provided therein lengthwisely. The first opening 4 thus defines two branched rib portions 5,5 of the shank 2 on both sides thereof.

The finger grip 3 of the moving side shear body 10*a* has a rubber hit point 20 mounted thereon at a position where the two finger grips 3,3 come into direct contact with each other when the scissors 1 are shut up.

Figure 13:
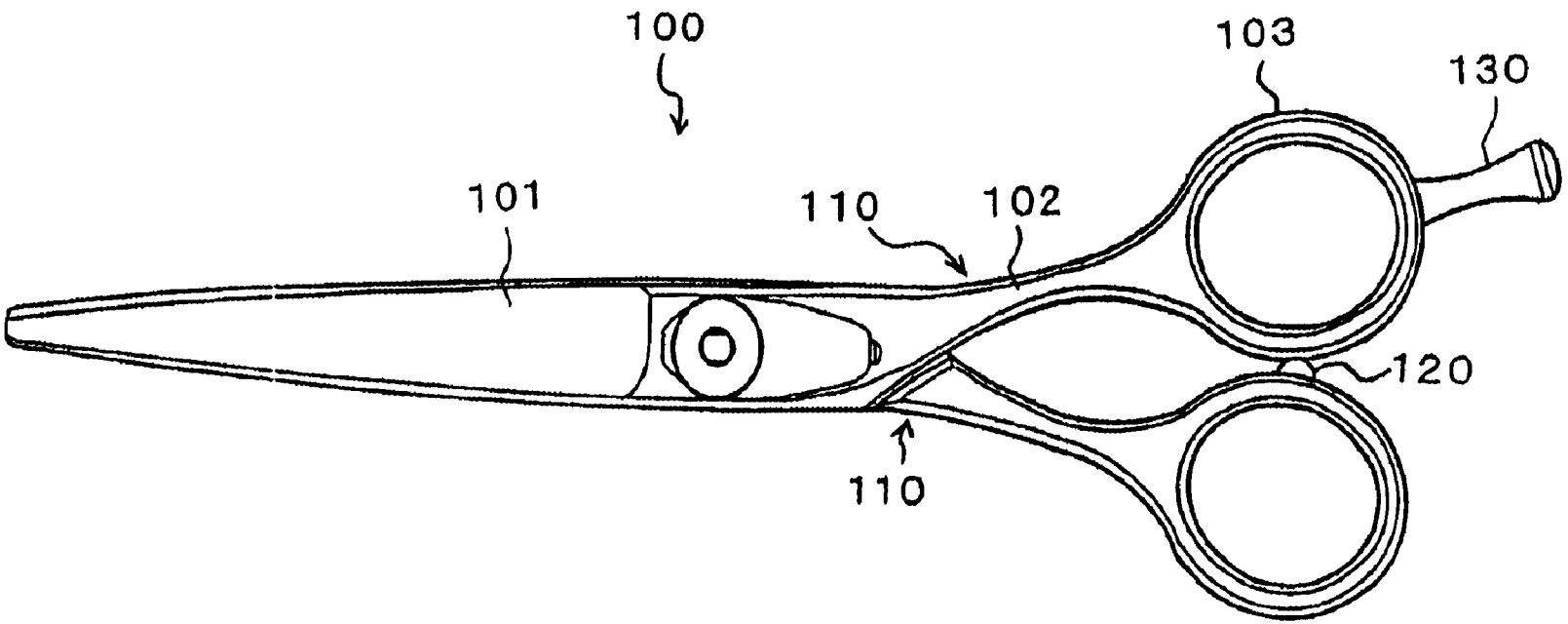
FIG. 13 PRIOR ART
FIG. 13 is a view of a conventional haircutting scissors.
Figure 14:
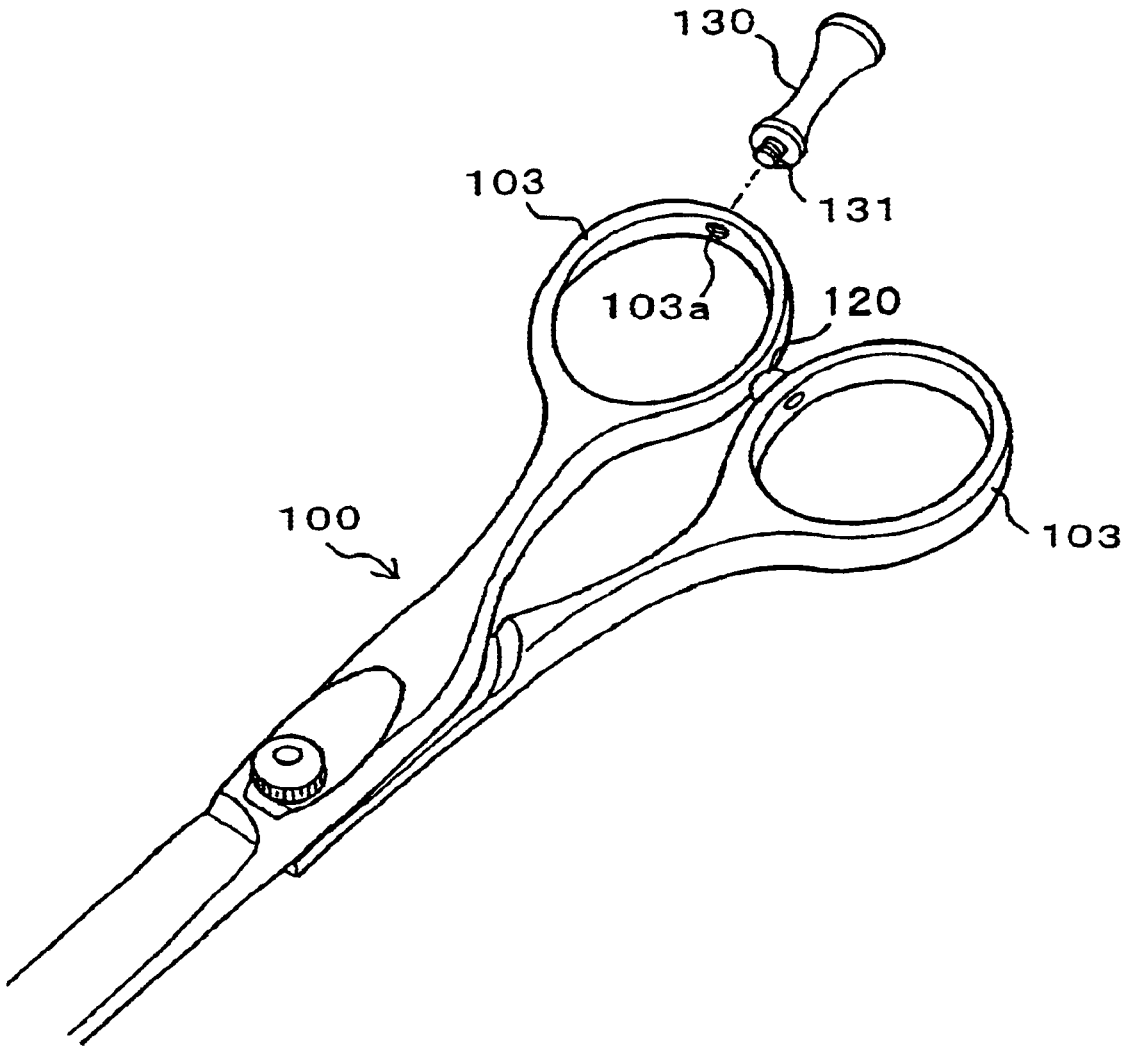
FIG. 14 PRIOR ART
FIG. 14 is an explanatory view illustrating the installation of a hit point and a finger brace to the conventional haircutting scissors.

The two rib portions 5,5 of the shank 2 are as thin as smaller in the weight than a common rod-shaped shank shown in FIG. 13. While the rib portions 5,5, are thin, they constitute a triangle shape with a portion of the finger grip 3, thus ensuring a higher level of strength against deflection of the shank 2. Since the shank 2 has a type of known rigid-frame structure, its rib portions 5,5 serve as truss beams. Although the proximal side X of the shank 2 is a bar-like shape similar to that of any conventional shank, the shank 2 will be less deflectable than the conventional shank.

Figure 2:
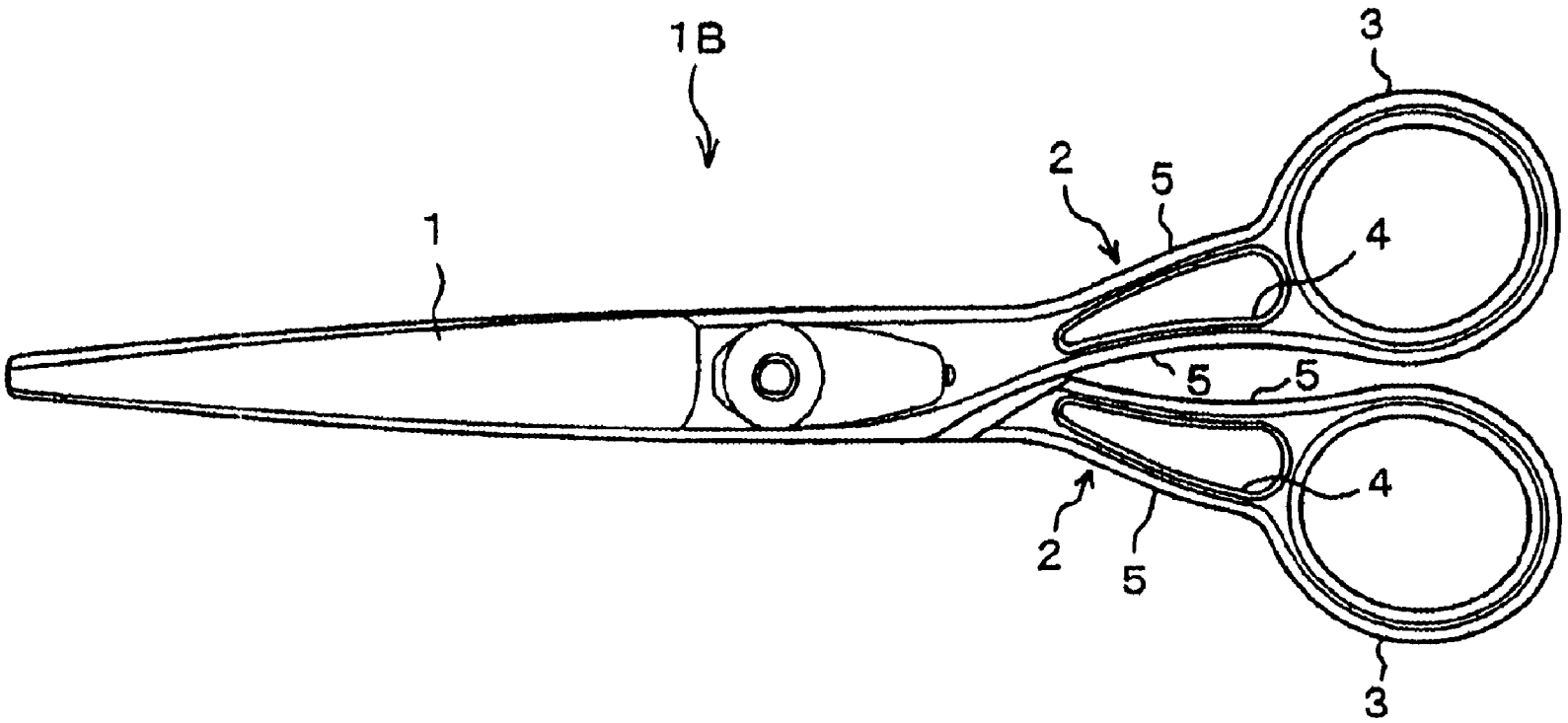
FIG. 2 is a view of a scissors having first openings provided in shanks thereof.

Shown in FIG. 2 is a scissors 1B having each first opening 4 shaped longer than that shown in FIG. 1. Accordingly, its shank 2 is composed substantially of two parallel ribs 5,5 thus contributing to the lighter weight and the more strength against deflection of the scissors.

Figure 3:
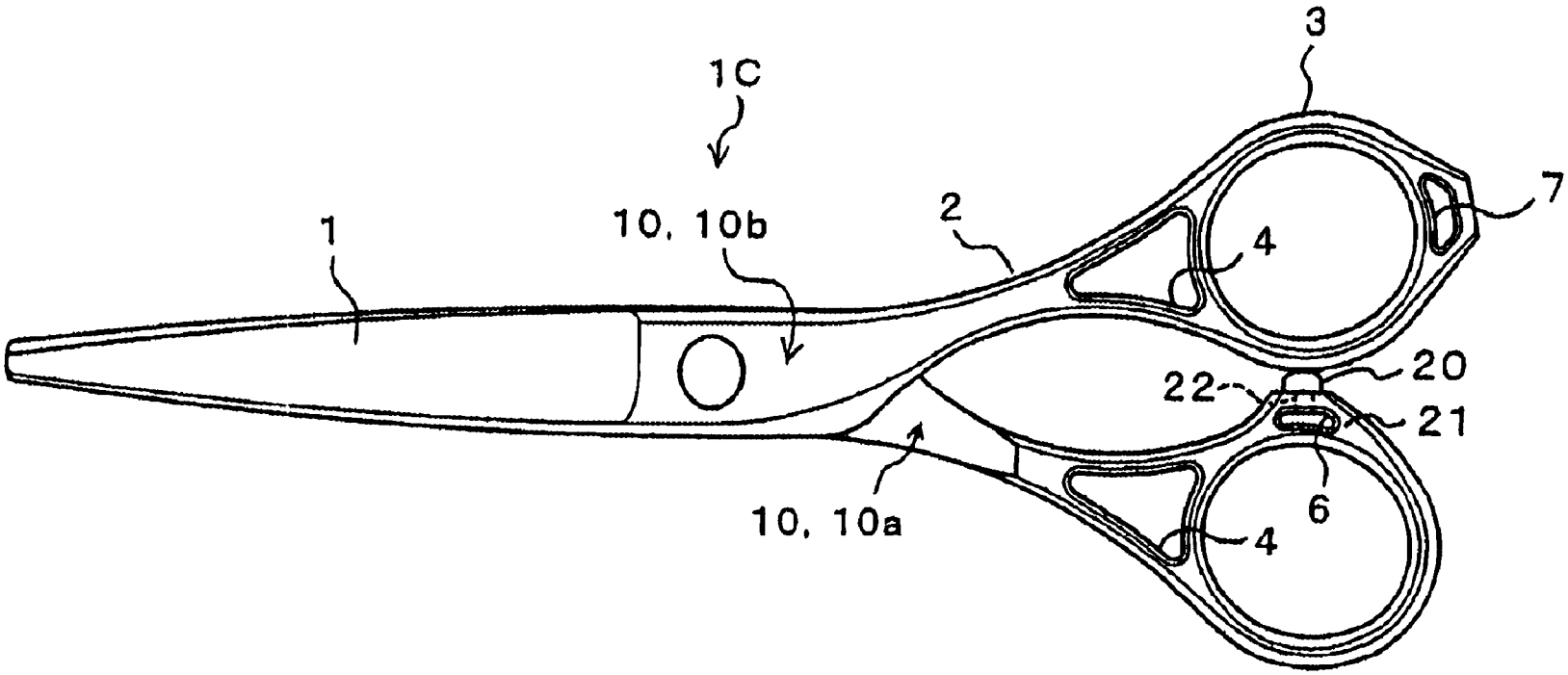
FIG. 3 is a view of a scissors having first openings 4 provided in shanks thereof and a second opening 6 provided in one at the moving blade side of shanks thereof for assisting the hit point, where the appearance is improved by providing a decorative opening 7 similar in function to the first and second openings.

Shown in FIG. 3 is a scissors 1C where a finger grip 3 of a moving side shear body 10*a* has a circumferential portion 21 thereof arranged wider in a plan view at the location accepting a hit point 20. The wider portion (21) has a second opening 6 of a narrow shape provided therein. Also, the wider portion has a thread hole 22 provided therein at the outside of the second opening 6 for accepting the hit point 20. The hit point 20 is screwed into the thread hole 22.

The shank 2 also has a first opening 4 provided therein of substantially a triangular shape similar to that shown in FIG. 1. The finger grip 3 of a stationary side shear body 10*b* has a decorative opening 7 provided therein for improving the appearance of the scissors together with the first openings 4 and the second opening 6.

Figure 4:
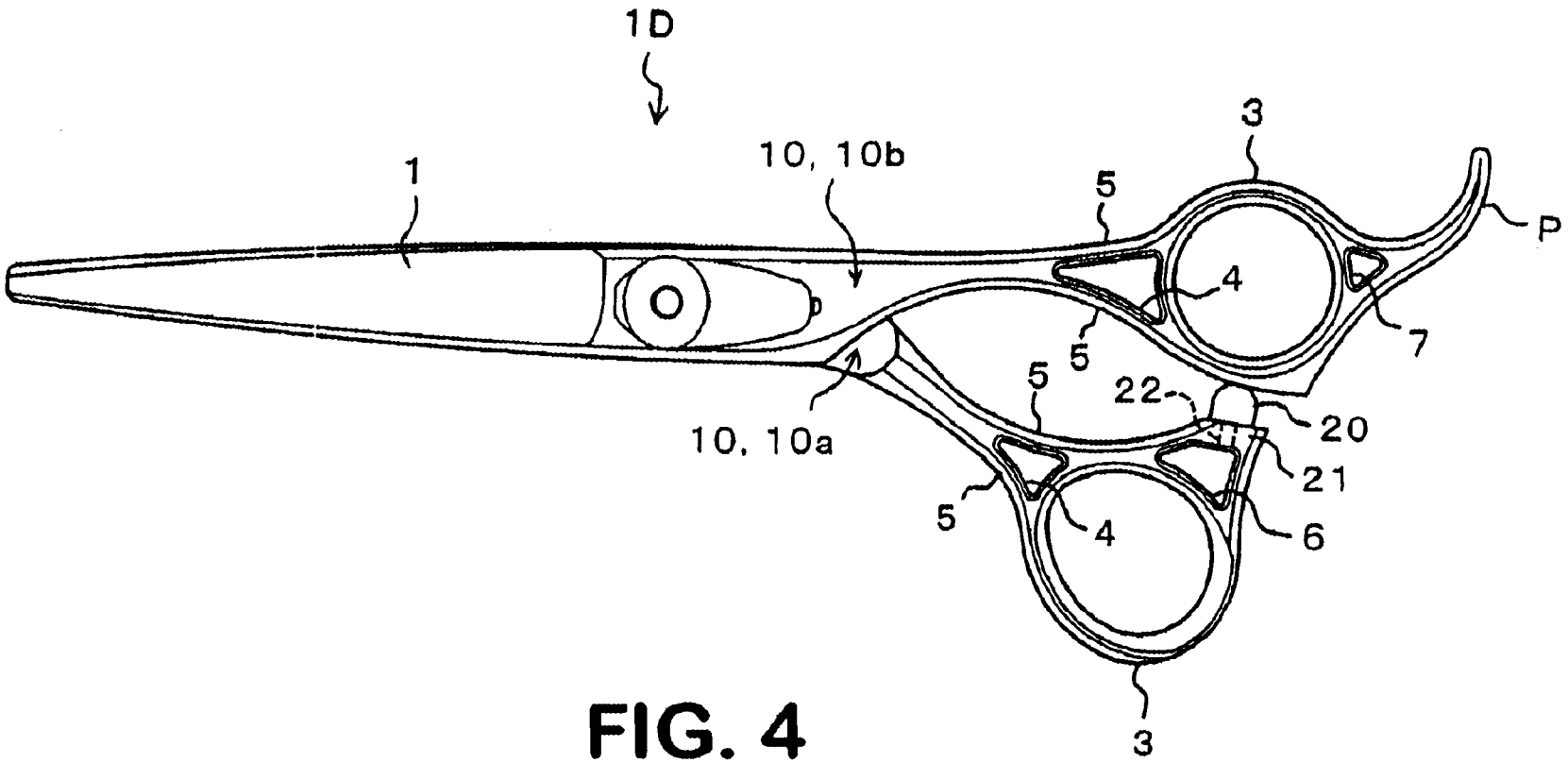
FIG. 4 is a view of a scissors having first openings 4 provided in shanks thereof and a second opening 6 provided in one at the moving blade side of shanks thereof, where a decorative opening 7 is provided in the proximal end of a finger brace P thereof.

Shown in FIG. 4 is a scissors ID where a shank 2 of a stationary shear body 10*b* has a first opening 4 provided therein while a finger grip 3 is arranged integral with a finger brace P and has a decorative opening 7 provided therein at the proximal side of the finger brace P. A moving side shear body 10*a* has a first opening 4 and a second opening 6 provide therein. A finger grip 3 of the moving side shear body 10*a* is arranged wider in a plan view at the location accepting a hit point 20 as its circumferential portion extends outwardly to substantially a trapezoid shape where a second opening 6 of a similar trapezoid shape is provided. A hit point 20 is screwed into a thread hole 22 provided in the finger grip 3 at the outer side of the second opening 6.

Figure 5:
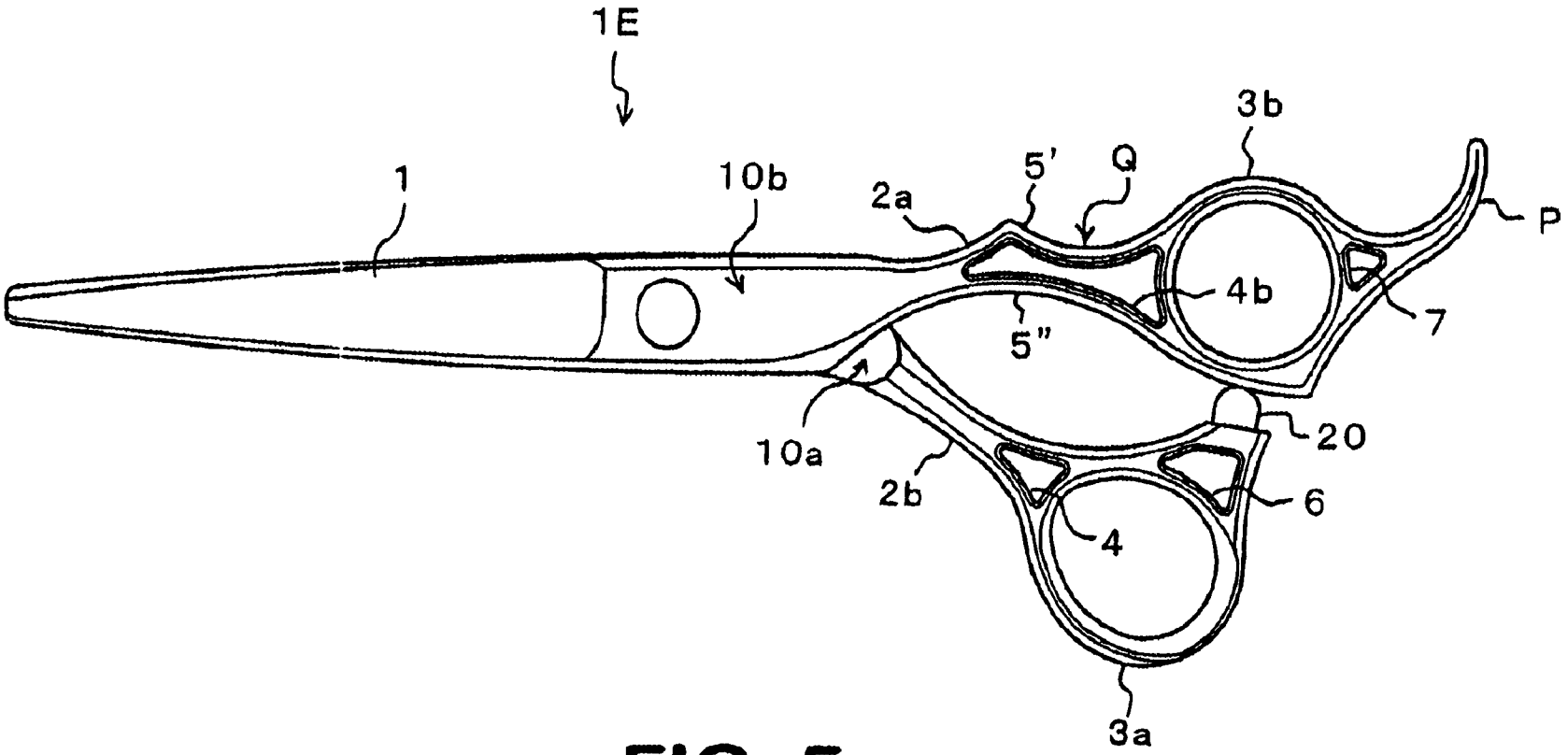
FIG. 5 is a view of a scissors having first openings provided in shanks thereof and a second opening 6 provided in one at the moving blade side of shanks thereof for assisting the hit point, where the shape Q of one first opening is designed for ease of accepting the index finger.

Shown in FIG. 5 is a scissors 1E which are identical in the structure to the scissors ID shown in FIG. 4 except that the shape of a first opening 4*b* provided in a stationary side shear body 10*b* is different. More particularly, as two rib portions 5' and 5" of a shank 2 are defined by the first opening 4*b*, the outer rib portion 5' (on which the finger is rested) has an inwardly curved configuration. When the scissors 1E are held by a hand, its moving side finger grip 3*a* and stationary side finger grip 3*b* engage with the thumb and the other fingers respectively. In general, while the middle finger is securely held in the finger grip 3*b*, the ring finger and the index finger are placed directly on a finger brace P and the shank 2*a* respectively. The inwardly curved shape Q of the rib portion 5' shown in FIG. 5 is designed for matching with the above holding manner. As its index finger is placed directly on the inwardly curved shape Q of the rib portion 5', the hand can hold the scissors with much ease.

Figure 6:
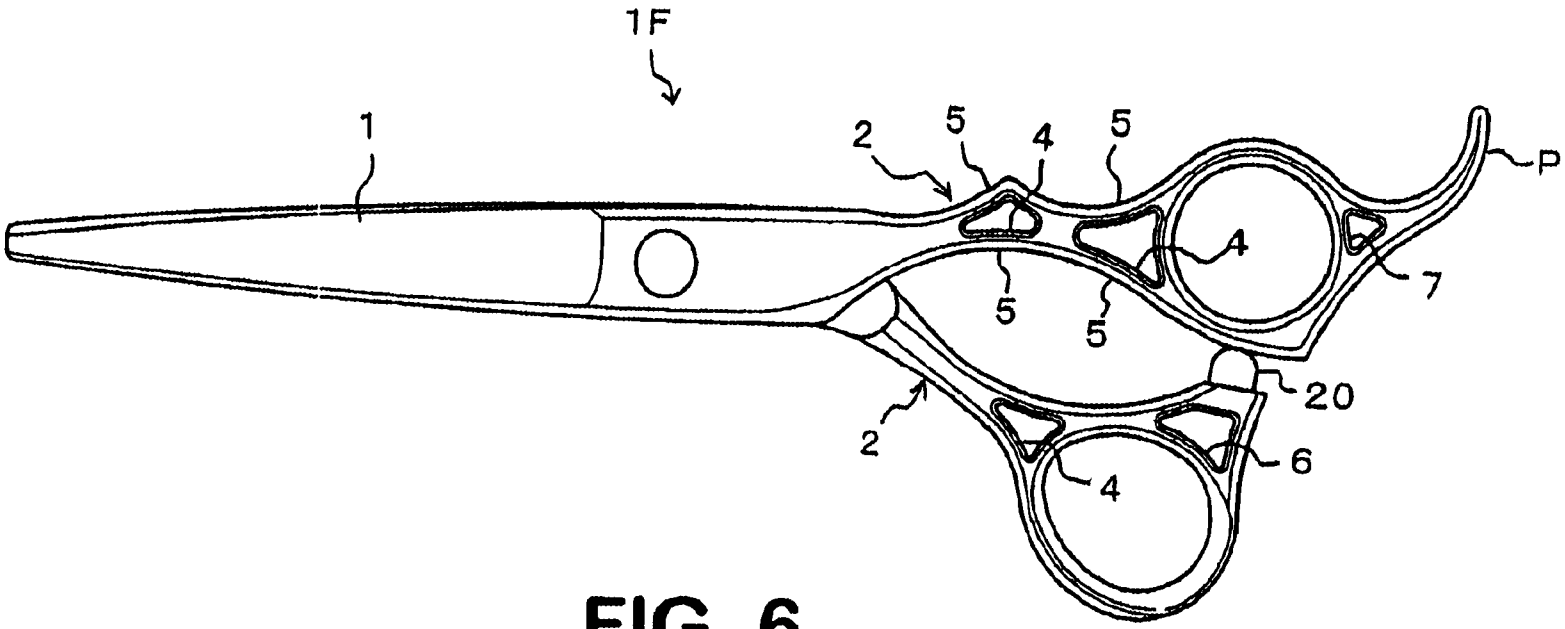
FIG. 6 is a view of a scissors having a coupe of first openings provided in one of shanks thereof.

Shown in FIG. 6 is a scissors 1F which is a modification of the scissors 1E. The first opening 4*b* shown in FIG. 5 is separated into two sections by a partition provided across the narrowest region of the opening 4*b*. The two sections of the first opening are denoted by 4,4 in FIG. 6. It is possible to provide two or more first openings in the shank 2*a*.

Figure 7:
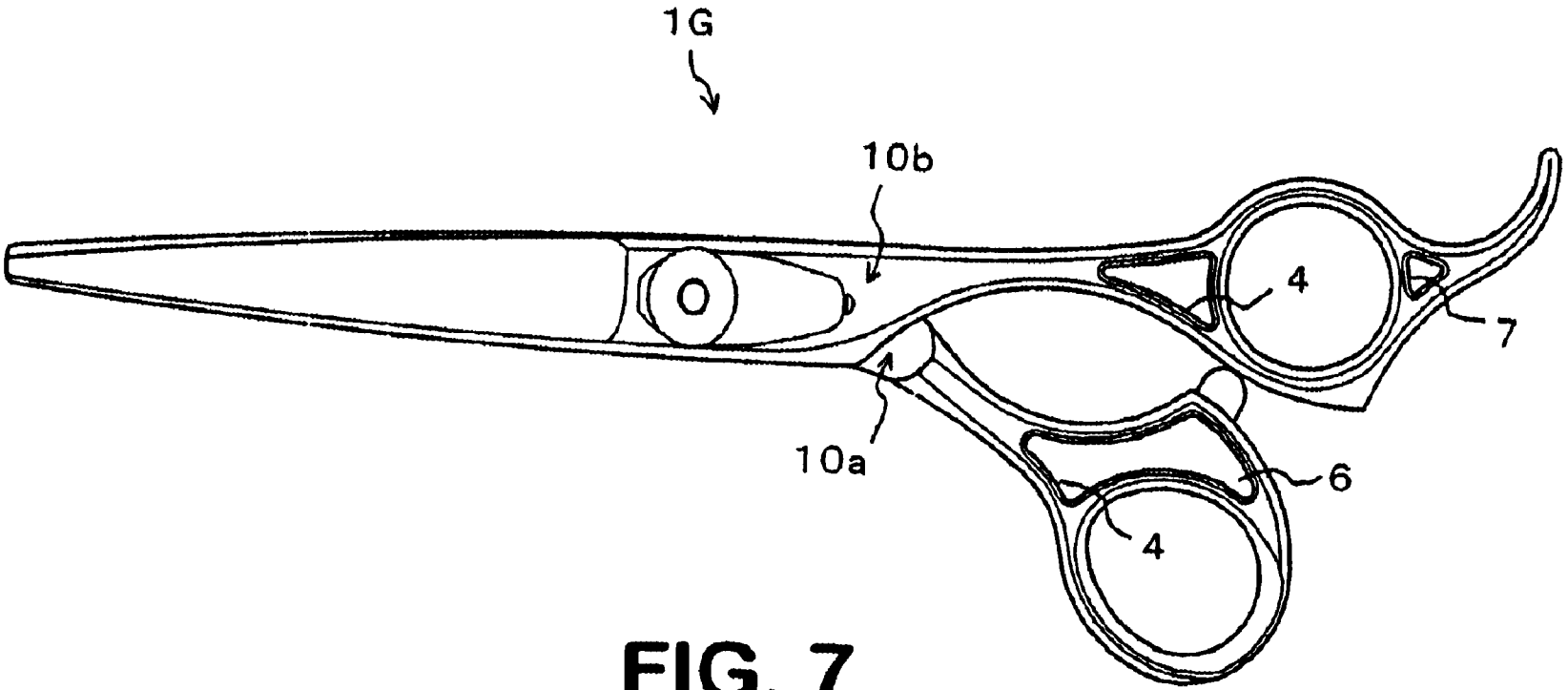
FIG. 7 is a view of a scissors having one of first openings 4 and a second opening 6 communicated with each other.

Shown in FIG. 7 is a scissors 1G where a stationary side shear body 10*b* has a first opening 4 and a decorative opening 7 provided therein similar to those shown in FIG. 4. A moving side shear body 10*a* of the scissors 1G has a relatively large opening provided therein extending from the location of a finger grip 3 where a hit point 20 is mounted to the distal end of a shank. A region of the opening adjacent to the hit point 20 acts as the second opening 6 while another region adjacent to the distal end of the shank acts as the first opening 4. Any combination of the first opening 4 and the second opening 6 may be used as a single opening.

Figure 8:
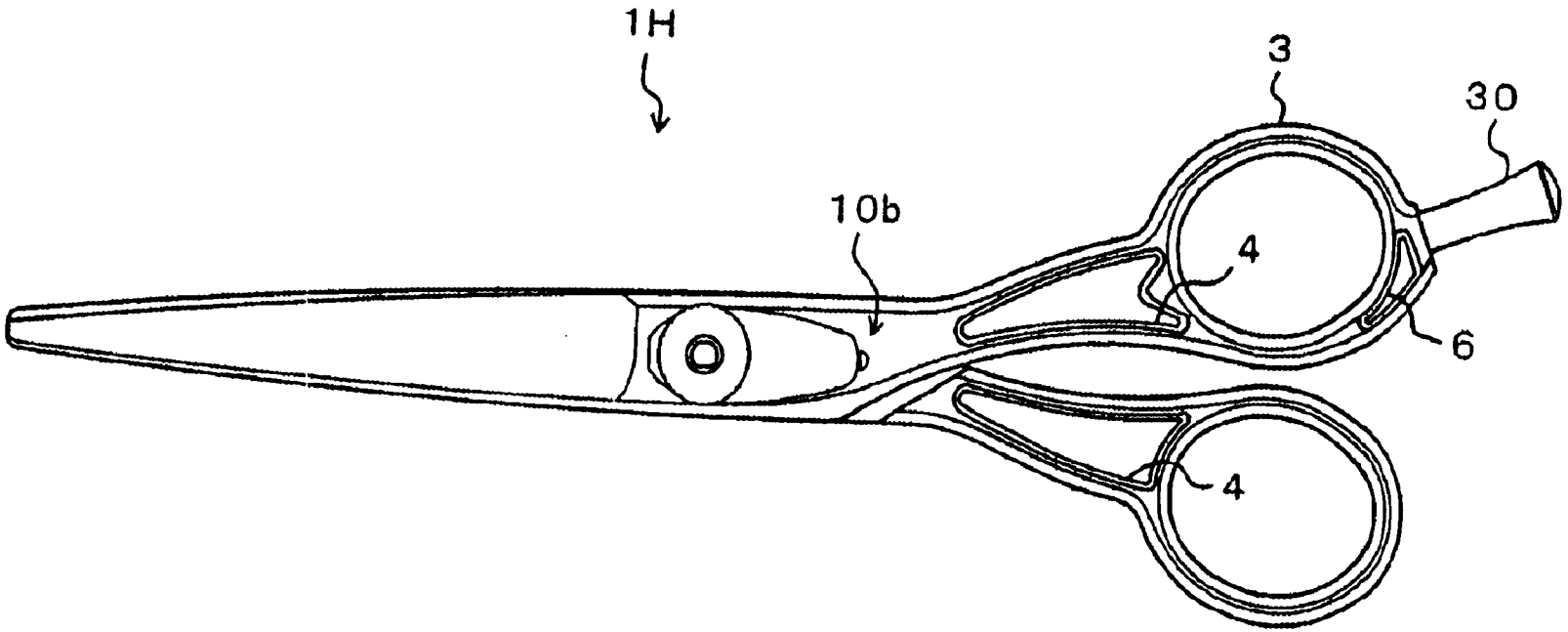
FIG. 8 is a view of a scissors having first openings 4 and a second opening 6 provided for assisting a finger brace 30.

Shown in FIG. 8 is a scissors 1H having first openings 4 and a second opening 6, The second opening 6 having a narrow triangular shape is provided in the finger grip of a stationary side shear body 10*b*. Also, a finger brace 30 is mounted by screwing to an outer portion of the finger grip at the outer side of the second opening 6.

Figure 9:
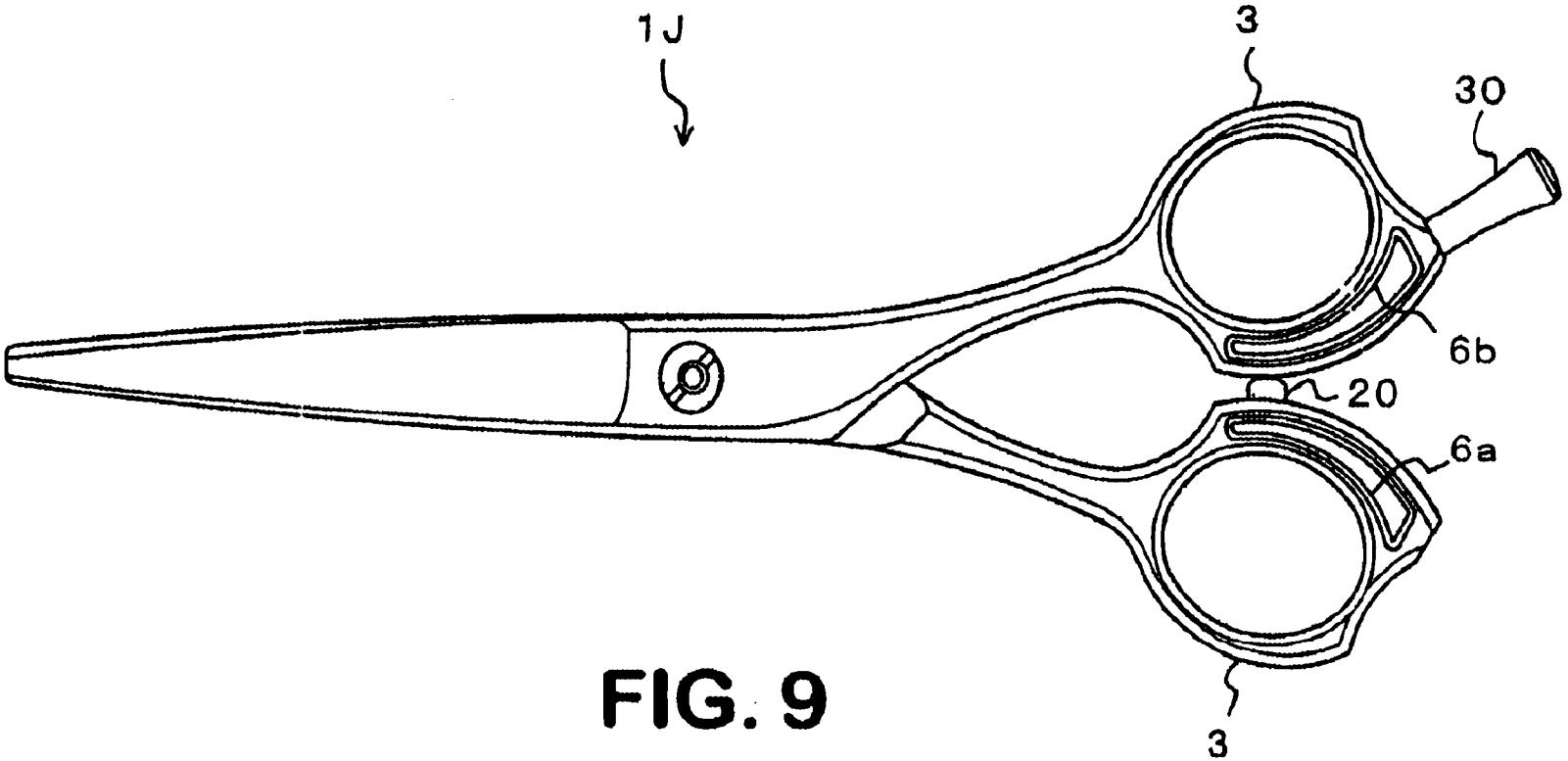
FIG. 9 is a view of a scissors having a couple of second openings 6 provided for assisting a finger brace 30 and a hit point 20 respectively.

Shown in FIG. 9 is a scissors 1J where two finger grips 3,3 have a second opening 6*a* and a second opening 6*b* of a narrow shape provided therein respectively. A finger brace 30 is mounted by screwing to an outer portion of the finger grip 3 of a stationary side shear body 10*b* at the outer side of the second opening 6*b* while a hit point 20 is mounted by screwing to an outer portion of the finger grip 3 of a moving side shear body 10*a* at the outer side of the second opening 6*a*.

Figure 10:
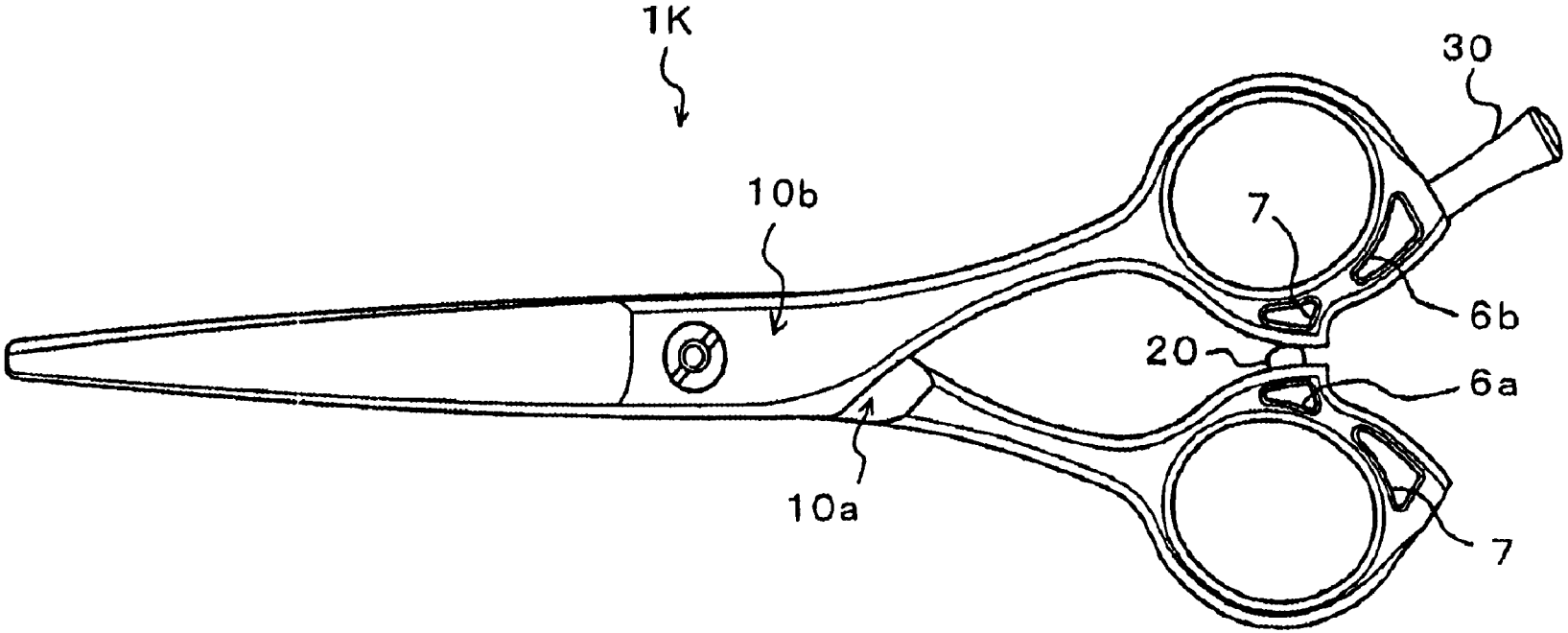
FIG. 10 is a view of a scissors having a couple of second openings 6, 6 provided for assisting a finger brace 30 and a hit point 20 respectively.

Shown in FIG. 10 is a scissors 1K having a couple of second openings 6*a*, 6*b* and a couple of decorative openings 7,7 provided therein.

Figure 11:
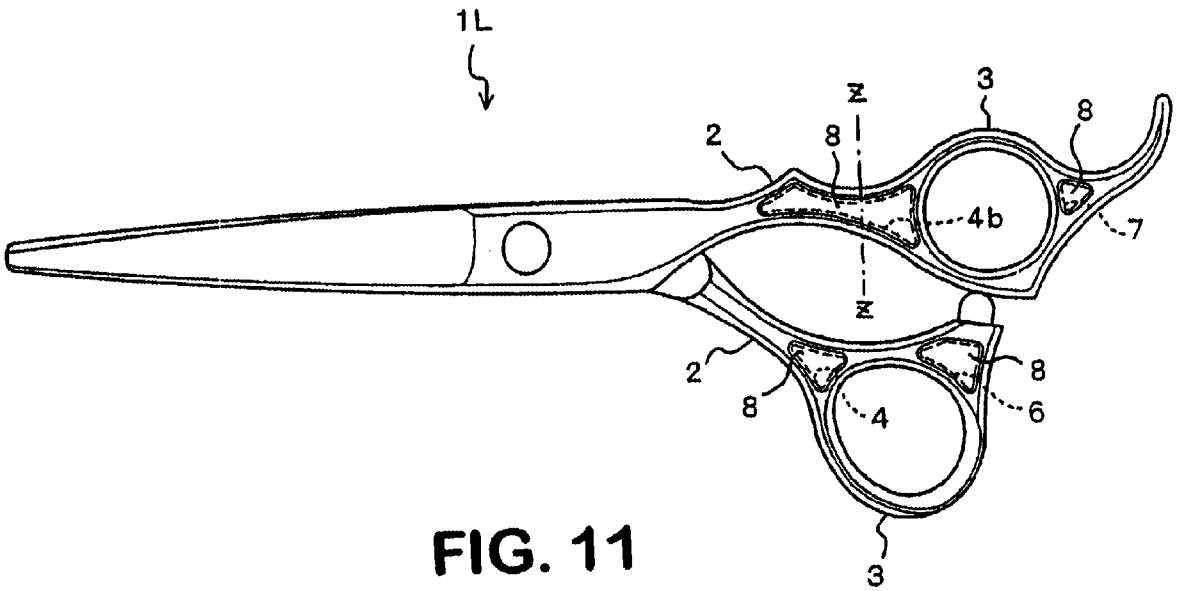
FIG. 11 is a view of a scissors having first, second, and decorative openings provided therein and shut up with plastic strips.
Figure 12:
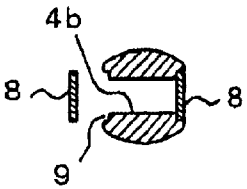
FIG. 12 is an explanatory cross sectional view taken along the line Z—Z of FIG. 11.

Shown in FIG. 11 is a scissors 1L where openings 4*b*, 4, 5, 6, and 7 similar to the first opening 4*b*, 4, the second opening 6, and the decorative opening 7 shown in FIG. 5 are shut up with light members 8,8 . . . of which the material is smaller in the weight than that of the shank 2. As best shown in FIG. 12, the light member 8 is a color plastic strip shutting up each side of the opening 4*b*, 4, 5, 6, and 7. A step 9 is provided on the shear body about the opening for accepting the plastic strips so that the plastic strip is flushed with the shank 2 and the finger grip 3.

It may be possible to close one or more of the openings separately. Also, the openings may be shut up at their outer surface or at their inward position spaced from both surfaces. The light members are not limited to the strips and may be of a plug form filling up the openings. More specifically, each of the openings may be shut up by any means or filled with an elastic material such as synthetic resin.

It would also be understood that the present invention is not limited to the foregoing embodiments.

The first and second openings may be arranged of any proper shape, not only a triangle but also a four-sided, a circle, an oval, or a diamond shape.

The first openings may be provided in one or both of the paired shear bodies. When the first openings are provided in both the shear bodies, their shape may be identical or different between the two shear bodies. The first opening may be replaced by a group of tiny openings.

What is claimed is:

1. Scissors having two shear bodies joined to each other for opening and closing movements, each shear body comprising a blade, a shank, and a finger grip, wherein the finger grip has a circumferential portion thereof arranged wider in a plan view;

first and second openings provided in the wider circumferential portion thereof;

and wherein a finger brace and a hit point are mounted to the circumferential portion of the finger grip at the outside of one of the openings.

2. Scissors having two shear bodies joined to each other for opening and closing movements, each shear body composed of a blade, a shank, and a finger grip, wherein the shank has a desired portion thereof arranged wider in a plan view and a first opening provided in the desired wider portion thereof.

3. Scissors according to claim 2, wherein the first opening is arranged extending lengthwise of the shank so that the shank has two rib portions.

4. Scissors according to claim 2 or 3, wherein the finger grip has a circumferential portion thereof arranged wider in a plan view and a second opening provided in the wider circumferential portion thereof and wherein a finger brace and a hit point are mounted to the circumferential portion of the finger grip at the outside of the second opening.

5. Scissors according to claim 2, wherein one of the first openings is shut up with a light member of which the material is of less weight than the shank.

6. Scissors according to claim 2 wherein the other of the let opening of the first is shut up with a light member of which the material is of less weight than the shank.

* * * * *